US010030922B2

(12) United States Patent
Gomez

(10) Patent No.: US 10,030,922 B2
(45) **Date of Patent: *Jul. 24, 2018**

(54) ADJUSTABLE GAS BLOCK FOR AN INDIRECT GAS OPERATED FIREARM

(71) Applicant: LWRC International LLC, Cambridge, MD (US)

(72) Inventor: Jesus S. Gomez, Trappe, MD (US)

(73) Assignee: LWRC International LLC, Cambridge, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/243,707

(22) Filed: Aug. 22, 2016

(65) Prior Publication Data

US 2017/0198998 A1 Jul. 13, 2017

Related U.S. Application Data

(63) Continuation of application No. 14/920,668, filed on Oct. 22, 2015, now Pat. No. 9,423,197, which is a continuation of application No. 14/291,455, filed on May 30, 2014, now Pat. No. 9,170,061, which is a continuation of application No. 12/929,928, filed on Feb. 24, 2011, now Pat. No. 8,875,614, which is a continuation of application No. 12/220,725, filed on Jul. 28, 2008.

(51) Int. Cl.
*F41A 5/28* (2006.01)
*F41G 1/02* (2006.01)

(52) U.S. Cl.
CPC . *F41A 5/28* (2013.01); *F41G 1/02* (2013.01)

(58) Field of Classification Search
CPC ..... F41A 5/28
USPC ..... 89/193
See application file for complete search history.

(56) References Cited

U.S. PATENT DOCUMENTS

| | | | |
|---|---|---|---|
| 1,431,059 | A | 10/1922 | Sutter |
| 1,738,501 | A | 12/1929 | Moore |
| 2,058,897 | A | 10/1936 | Marek |
| 2,286,776 | A | 6/1942 | Williams et al. |
| 2,340,293 | A | 2/1944 | Balleisen |
| 2,560,292 | A | 7/1951 | Kauch |
| 2,732,769 | A | 1/1956 | Simpson |

(Continued)

OTHER PUBLICATIONS

US 8,752,473, 06/2014, Gomez (withdrawn)

(Continued)

*Primary Examiner* — Reginald Tillman, Jr.
(74) *Attorney, Agent, or Firm* — Porzio, Bromberg & Newman P.C.

(57) ABSTRACT

A firearm including a barrel, receiver, indirect gas system and an adjustable gas block designed to interface with the indirect gas system is provided. Four indexable positions of adjustment are provided for on the adjustable gas block. Positions of adjustment are selected based on the use of a silencer, use of under-powered ammunition, the presence of un-burnt powder and debris in the host firearms operating system, or if the weapon is being fired under "ideal" circumstances. The provided gas block is designed to function with an indirect gas operating system. Excess gas from the operating system is not vented from the gas block thereby generating excess flash and sound. No tool is required to manipulate the adjustment mechanism of the gas.

10 Claims, 5 Drawing Sheets

(56) References Cited

U.S. PATENT DOCUMENTS

| | | | | |
|---|---|---|---|---|
| 2,748,662 | A | 6/1956 | Simpson | |
| 4,447,195 | A | 5/1984 | Schuck | |
| 4,714,091 | A | 12/1987 | Wagner | |
| 4,798,124 | A | 1/1989 | Hurlemann et al. | |
| 5,622,142 | A | 4/1997 | Strieber et al. | |
| 5,945,626 | A | 8/1999 | Robbins | |
| 7,461,581 | B2 | 12/2008 | Leitner-Wise | |
| 7,775,150 | B2 | 8/2010 | Hochstrate et al. | |
| 7,856,917 | B2 | 12/2010 | Noveske | |
| 7,891,284 | B1 | 2/2011 | Barrett | |
| 8,607,688 | B2 | 12/2013 | Cassels | |
| 8,863,639 | B2 | 10/2014 | Gomez | |
| 8,875,614 | B2 | 11/2014 | Gomez | |
| 9,170,061 | B2 | 10/2015 | Gomez | |
| 9,243,859 | B1 | 1/2016 | Miller et al. | |
| 9,423,197 | B2 * | 8/2016 | Gomez | F41A 5/28 |
| 2006/0086099 | A1 | 4/2006 | Dickerson et al. | |
| 2006/0283318 | A1 | 12/2006 | Beaty | |
| 2010/0218671 | A1 | 9/2010 | Mayberry et al. | |
| 2011/0186305 | A1 | 8/2011 | Wilde | |
| 2014/0260947 | A1 | 9/2014 | Gomez | |

OTHER PUBLICATIONS

In the U.S. Patent and Trademark Office, Office Action in re: U.S. Appl. No. 12/220,725, dated Aug. 24, 2010, 7 pages.
In the U.S. Patent and Trademark Office, Office Action in re: U.S. Appl. No. 12/929,928, dated Jan. 12, 2012, 7 pages.
In the U.S. Patent and Trademark Office, Final Office Action in re: U.S. Appl. No. 12/929,928, dated Jul. 24, 2012, 7 pages.
In the U.S. Patent and Trademark Office, Office Action in re: U.S. Appl. No. 12/929,928, dated Jan. 15, 2013, 8 pages.
In the U.S. Patent and Trademark Office, Final Office Action in re: U.S. Appl. No. 12/929,928, dated Sep. 12, 2013, 7 pages.
In the U.S. Patent and Trademark Office, Notice of Allowance in re: U.S. Appl. No. 12/929,928, dated Feb. 3, 2014, 5 pages.
In the U.S. Patent and Trademark Office, Office Action in re: U.S. Appl. No. 14/291,455, dated Jul. 30, 2014, 9 pages.
In the U.S. Patent and Trademark Office, Final Office Action in re: U.S. Appl. No. 14/291,455, dated Mar. 23, 2015, 7 pages.
In the U.S. Patent and Trademark Office, Notice of Allowance in re: U.S. Appl. No. 14/291,455, dated Jun. 26, 2015, 7 pages.
In the U.S. Patent and Trademark Office, Office Action in re: U.S. Appl. No. 14/790,660, dated Feb. 2, 2016, 8 pages.
In the U.S. Patent and Trademark Office, Notice of Allowance in re: U.S. Appl. No. 14/920,668, dated Apr. 27, 2016, 5 pages.
In the U.S. Patent and Trademark Office, Final Office Action in re: U.S. Appl. No. 14/920,668, dated Feb. 10, 2016, 6 pages.
In the U.S. Patent and Trademark Office, Office Action in re: U.S. Appl. No. 13/593,021, dated Feb. 5, 2014, 6 pages.
In the U.S. Patent and Trademark Office, Notice of Allowance in re: U.S. Appl. No. 13/593,021, dated Jun. 12, 2014, 5 pages.
In the U.S. Patent and Trademark Office, Office Action in re: U.S. Appl. No. 14/484,715, dated Dec. 19, 2014, 4 pages.
In the U.S. Patent and Trademark Office, Notice of Allowance in re: U.S. Appl. No. 14/484,715, dated Apr. 14, 2015, 6 pages.
In the U.S. Patent and Trademark Office, Notice of Allowance in re: U.S. Appl. No. 14/790,660, dated Jul. 27, 2016, 8 pages.
In the U.S. Patent and Trademark Office, Notice of Allowance in re: U.S. Appl. No. 15/000,587, dated Apr. 7, 2017.

* cited by examiner

ADJUSTABLE GAS BLOCK FOR AN INDIRECT GAS OPERATED FIREARM

This application is a continuation of U.S. patent application Ser. No. 14/920,668, filed Oct. 22, 2015, now U.S. Patent No. 9,423,197, which is a continuation of U.S. patent application Ser. No. 14/291,455, filed May 30, 2014, now U.S. Pat. No. 9,170,061, which is a continuation of U.S. patent application Ser. No. 12/929,928, filed Feb. 24, 2011, now U.S. Pat. No. 8,752,473, which is a continuation of U.S. patent application Ser. No. 12/220,725, filed Jul. 28, 2008, the disclosure of each of which is incorporated herein by reference.

BACKGROUND OF THE INVENTION

1. Field of the Invention

This present invention generally relates to self loading firearms, specifically to gas blocks for self loading firearms which facilitate user adjustment of the gas flow from the barrel into the operating system.

2. Description of the Related Art

The need to regulate the gas flow between the barrel and operating system of a firearm has been a concern since the introduction of autoloading firearms. Gas is generated during the combustion of gun powder present in the cartridges used in modern firearms. This gas expands violently to push the bullet out of the firearm's barrel. These expanding gases are utilized as a means to operate the action of the host firearm. In modern firearms the preferred method of facilitating the function of an autoloading weapon is as follows. A hole is placed thru the barrel, generally on the top. Location of this hole or gas port varies between operating systems. Generally a gas port size is chosen to allow a broad range of ammunition to be utilized while guaranteeing the reliable function of the host firearm.

Unfortunately due to varying lengths of barrels, ammunition variance, and other factors it is very difficult to choose a gas port size which universally works under all conditions. A popular way of dealing with these problems is to incorporate an adjustable gas block into the operating system.

An adjustable gas block allows for the flow of gas between the gas port in the barrel and the operating system of the firearm to be increased or decreased based on mitigating factors present at the time of use. These systems typically work by utilizing an oversized gas port with means to adjust the flow of gas into the operating system and by venting the unneeded gases from the barrel into the atmosphere thus generating flash and sound. Further, adjustment of the gas system typically requires a special tool and offers no way for the user to index the system and make adjustments due to mitigating circumstances quickly. Designs such as these are well known in the prior art and can be found on the Belgium FAL, Soviet SVD and the Yugoslavian M76 rifle.

Recent firearm designs such as the FN SCAR rifles have incorporated adjustable gas blocks to be used in conjunction with noise suppressors. Noise suppressors provide a means to redirect, cool and slow the expanding gases generated from the discharge of a firearm so that the resulting flash and sound generated by the firearm is minimized or eliminated. As a result, back pressure is generated forcing more gas into the firearm's operating system. This extra gas, or back pressure increases the firing rate of a weapon during its full auto function, fouls the weapon leading to premature malfunction and to a variety of feeding and extraction problems.

Modern rifle designs such as the FN SCAR rifles incorporate adjustable gas blocks which have selectable pre-set positions. Typically two or three positions of adjustment are afforded the user. A reduced gas flow setting on an adjustable gas block is generally present due to military and government agency requirements. Reducing the standard gas flow is desirable when a silencer is to be used. Silencers increase back pressure and the cyclic rate of the host firearm. By reducing the amount of gas directed to the operating system under normal circumstances, the silencer, with the increased pressure it generates, should not affect the weapon's operation adversely. While designs with an adjustable gas block mitigate the potential problems associated with the increase of back pressure and fouling a noise suppressor generate, gases are still vented out of the gas block thus generating flash and sound. Generating flash and sound from the gas block is counterproductive to the function of the silencer which is attempting to reduce the flash and sound from the muzzle of the host firearm.

The present invention offers several advantages over the prior art. Four positions of adjustment are provided for. Position one offers a "standard" flow of gas. This position is optimized for the firearm's barrel length and caliber. Position two reduces the flow of gas into the indirect gas operating system so that with the addition of a silencer the indirect gas operating system is still receiving an equivalent amount of gas as was being provided by position one when no silencer was being utilized. Position three blocks the flow of gas between the barrel gas port and the indirect operating system. This position optimizes the sound reduction capability of an attached noise suppressor. Position four increases the amount of gas being communicated to the operating system so that the firearm may operate properly while dirty or when underpowered ammunition is being utilized. Each of the aforementioned positions of adjustment are indexed with a spring and ball detent, and are pre-set at the factory. No tool is required to rotate the adjustment cylinder into one of the four positions. There is no vent in the gas block which allows for excess gas or un-burnt powder to exit.

SUMMARY OF THE INVENTION

Accordingly several objects and advantages of the present invention are (a) To provide the user an indexing means to adjust the flow of gas into the operating system of a firearm.

(b) To provide a device which restricts the flow of gas into the operating system without venting excess gas from the gas block.

(c) To provide an adjustment mechanism which does not require the use of special tools.

(d) To provide an adjustable gas block that may be utilized with an indirect gas system.

(e) To provide an adjustable gas block with a means to provide gas that is in excess of what is required to help the weapon function in adverse conditions or with underpowered ammunition.

In accordance with one embodiment of the present invention, a firearm is provided comprising a receiver, a barrel, an adjustable gas block for an indirect gas operated firearm and an indirect gas system. The adjustable gas block is fixedly secured to the barrel and aligned with the gas port hole located thereon. A rotating cylinder provides an indexing, adjustment means for the gas block. By rotating the provided cylinder the flow of gas between the barrel and the indirect gas system is either increased or decreased. Four positions of adjustment are afforded the user: A standard gas flow, suppressed gas flow, no gas flow, and an adverse conditions gas flow setting. For adverse conditions the gas flow is increased over what the host weapon would typically require to compensate for a dirty operating system.

Still further objects and advantages will become apparent from a consideration of the ensuing description and drawings.

DESCRIPTION OF THE DRAWINGS

The novel features believed to be characteristic of the present invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended to define the limits of the invention.

DETAILED DESCRIPTION OF THE PREFERRED EMBODIMENT

Figure 1:
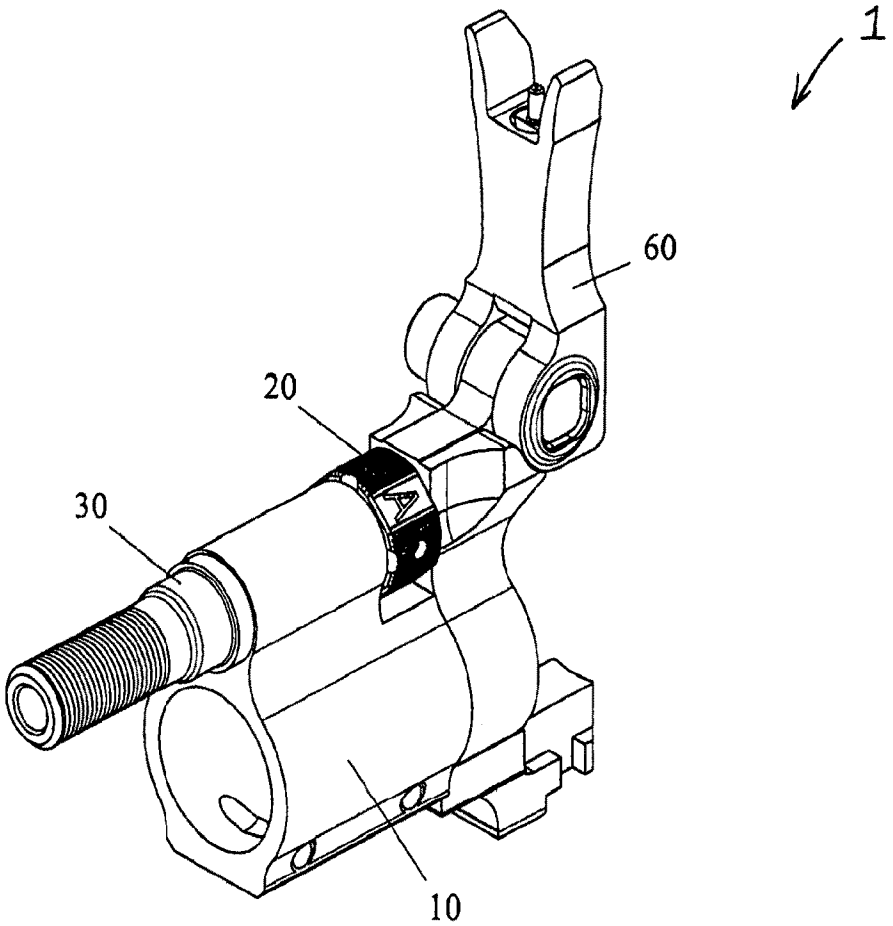
FIG. 1 is a side perspective view of an adjustable gas block for an indirect gas operated firearm in accordance with the present invention.

The adjustable gas block, generally designated by reference numeral 1, for an indirect gas operated firearm is designed to provide four positions of adjustment, each of which affects the flow of gas from the barrel gas port into the operating system of the host firearm. The herein disclosed device is designed for an indirect gas operating system, but it should be noted that this device is not limited to such operating systems and in fact could be utilized with a gas impingement operating system such as is found on the M16 family of firearms.

As shown in FIG. 1, which illustrates the preferred embodiment of the present invention, the adjustable gas block 1 for an indirect gas operated firearm is a replacement for a standard gas block, well known in the prior art, for an autoloading firearm. The adjustable gas block 1 for an indirect gas operated firearm is comprised of a housing 10, an adjustment knob 20, a nozzle assembly 30, also referred to as a gas nozzle, and a front sight 60.

Figure 2:
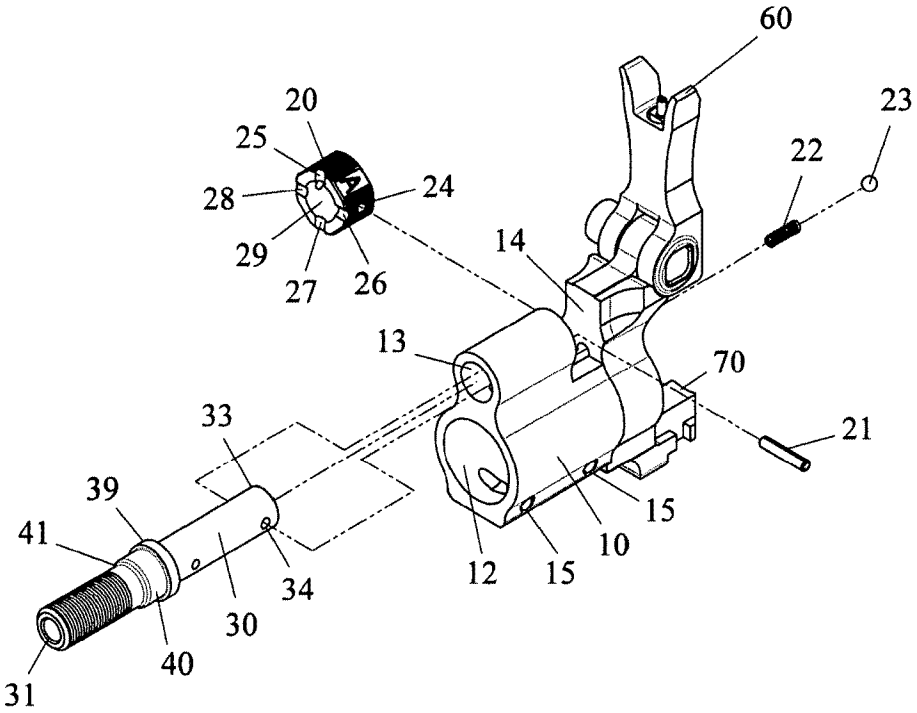
FIG. 2 is an exploded view of the gas block shown in FIG. 1.

In FIG. 2, there is illustrated an exploded view of the adjustable gas block 1 for an indirect gas operated firearm and all of its components. The housing 10 has a gas nozzle receiving channel 13 which is located above the barrel receiving channel 12. Near the distal end of the housing 10 is located a groove 14 for the adjustment knob 20. The groove is transverse to the longitudinal axis of the barrel and is bounded on one side by a front surface of the gas block adjacent the gas nozzle receiving channel and on the other side by a solid rearwardly facing surface of the gas block. Located along the bottom of the housing 10 are two thru pin placements 15 which receive two taper pins that are utilized to secure the unit as a whole about the barrel 101 (see FIG. 5). A front sight 60 is provided for on the distal end of the housing 10 along with a bayonet lug 70.

The preferred embodiment gas nozzle 30 consists of a front end 33, a back end and a middle portion. The front end 33 of the gas nozzle 30, which does not have an opening, protrudes from the front of the gas nozzle receiving channel 13 and into the groove 14. The back end protrudes from the rear of the housing and has an opening 31 into the gas nozzle which is in communication with gas ports 35, 36 and 37 (shown in FIG. 3). The middle area consists of the structural features between the front end 33 and the opening 31 at the back end. Structural features found on the middle area are the connecting member 39, the radial flange 40, an opening 34 for a pin 21 and the diameter-reducing transition portion 41.

The adjustment knob 20 has a front face, a rear face, and a generally annular body surrounding a central opening or bore 29, said rotatable knob being received within said transverse groove with the knob rear face adjacent the front side of the gas nozzle receiving channel cylindrical bore and the knob front face adjacent a rearwardly facing surface of the housing. The adjustment knob 20 includes a series of slots 25-28 located about the periphery of the rear face of the adjustment knob 20. The central opening or bore 29 of the adjustment knob 20 receives a front portion of the gas nozzle 30. An opening 24 is present on the exterior of the adjustment knob 20 and is designed to receive a pin 21.

Figure 3:
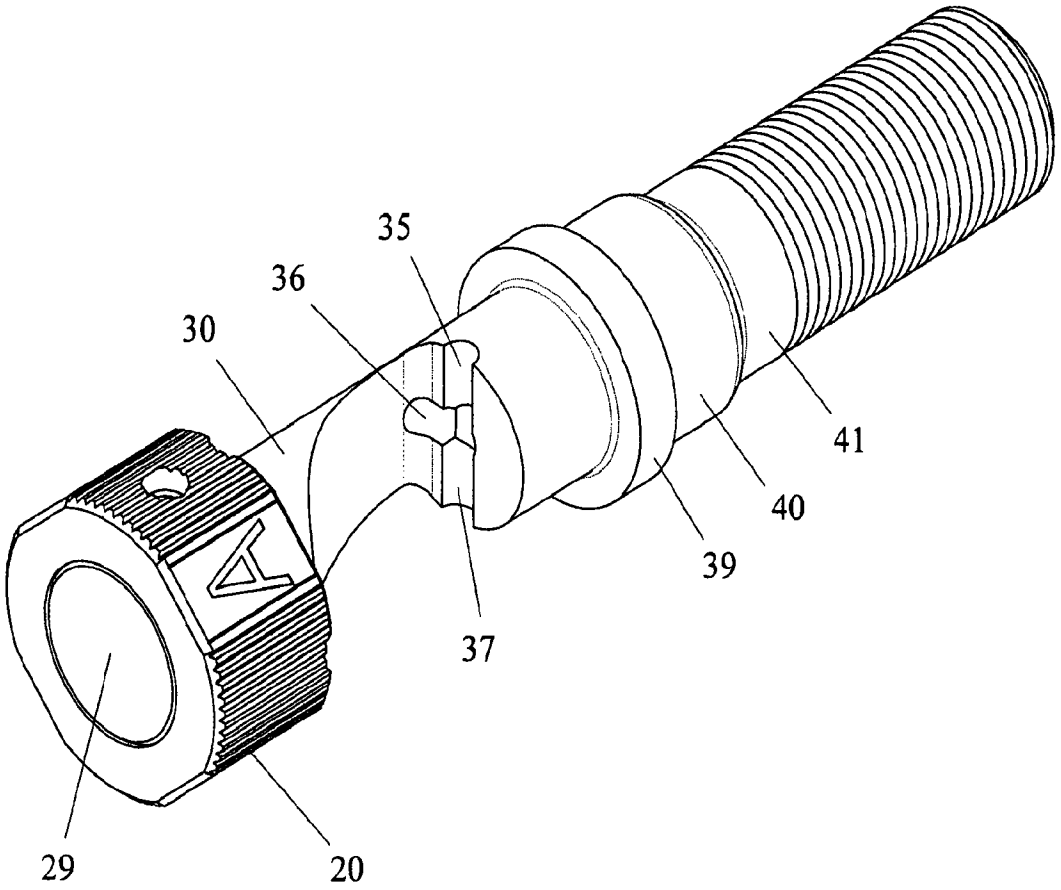
FIG. 3 is a partial cutaway view of the nozzle assembly and adjustment knob which are parts of the gas block shown in FIGS. 1 and 2.

In FIG. 3 there is illustrated a view of the adjustment knob 20 assembled with the gas nozzle 30. The gas nozzle 30 is partially cut away to reveal the three gas ports 35, 36 and 37. Gas port 36 is at a 90 degree angle with respect to each of gas ports 35 and 37, and gas ports 35 and 37 are positioned 180 degrees from one another. Gas port one 35, gas port two 36, and gas port three 37 are each unique in size. These gas ports 35-37 all intersect in the center of the gas nozzle 30. Each of the gas ports is in communication with the opening 31 located at the front of the gas nozzle 30 and the bore 38 therethrough.

Figure 4:
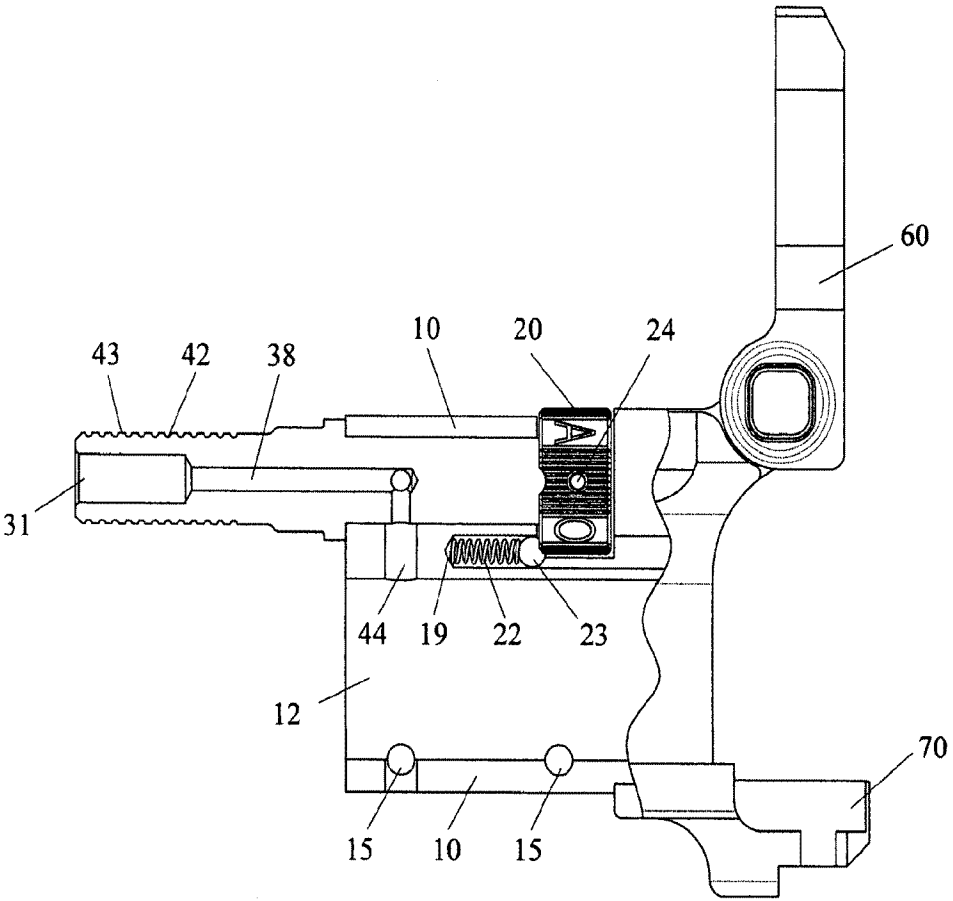
FIG. 4 is a side cutaway view of the adjustable gas block for an indirect gas operated firearm shown in FIG. 1.

FIG. 4 illustrates a cutaway view of the adjustable gas block 1. The housing 10 houses a spring 22 and ball detent 23 in a void 19. A gas port 44 thru the housing 10 is in communication with both the gas nozzle 30 and the gas port of the barrel 101. The gas nozzle 30 has a bore 38 which is in communication with an opening 31 of the gas nozzle 30 and the gas port 44 located in the housing 10. The adjustment knob 20 is secured about the gas nozzle 30 by means of a pin 21 which is inserted through an opening 24 in the adjustment knob 20 and then through the opening 34 located on the gas nozzle 30.

Figure 5:
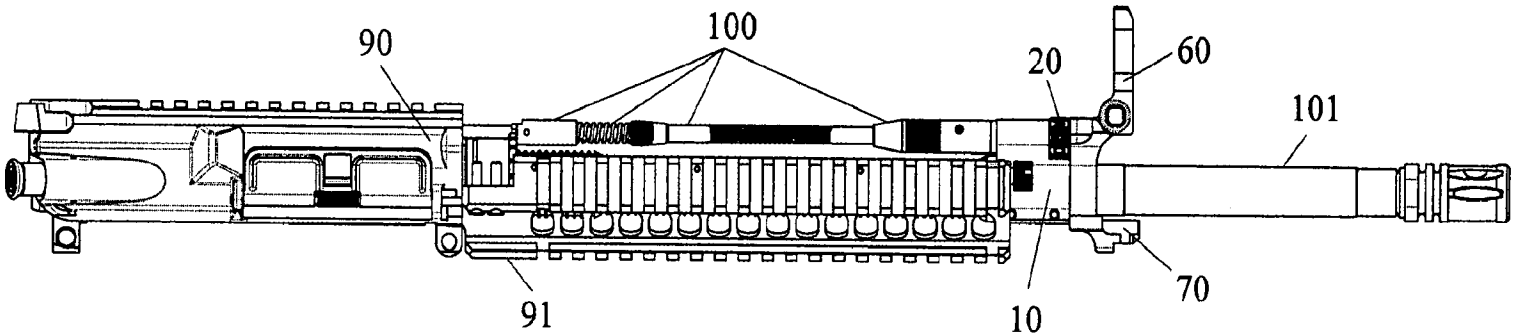
FIG. 5 is a side perspective view of the adjustable gas block for an indirect gas operated firearm shown with the firearm receiver and barrel.

FIG. 5 illustrates a perspective view of a firearm receiver 90 connected to a barrel 101 utilizing a removable rail 91 (also referred to as a handguard) which incorporates an indirect gas operating system 100 and the adjustable gas block 1.

As used herein, the word "front" or "forward" corresponds to the direction right of the adjustable gas block 1 as shown in FIGS. 1 thru 5; "rear" or "rearward" or "back" corresponds to the direction opposite the front direction of the adjustable gas block 1, i.e., to the left as shown in FIGS. 1 thru 5; "longitudinal" means the direction along or parallel to the longitudinal axis of the adjustable gas block 1; and "transverse" means a direction perpendicular to the longitudinal direction.

The adjustable gas block 1 is assembled as follows. The spring 22 and ball detent 23 are inserted in the void 19 located within the housing 10. A placement area or groove 14 formed in the housing 10 receives the adjustment knob 20 therein and retains the spring 22 and ball detent 23 in place. The spring 22 provides a force to the ball detent 23 which interacts with the indexing notches 25, 26, 27 and 28 located about the adjustment knob 20 and provides an indexing means for the orientation of the gas nozzle 30. The interaction between the ball detent 23 and the indexing notches 25-28 prevents the unintentional rotation of the adjustment knob 20 during routine use of the host firearm. The gas nozzle 30 is inserted through the gas nozzle receiving channel 13 and through the central opening 29 in the adjustment knob 20. The gas nozzle 30 is initially oriented such that the openings 34 align with the openings 24 on the adjustment knob 20 where a pin 21, preferably a roll pin type, is pushed through. This retains the adjustment knob 20 and the gas nozzle 30 in place. A portion of the barrel 101 is received by the barrel receiving channel 12 located on the housing 10. Once the through pin placements 15 are aligned with the existing openings on the barrel 101, two pins are then used to secure the adjustable gas block 1 to the barrel 101 and thus prevent the rotation and longitudinal movement of the housing 10.

When a firearm is discharged, expanding gases travel down the barrel 101 with a small amount of this gas being vented through a gas port located on the top of the barrel 101. This gas then travels through the gas port 44 located in the housing 10 into the bore 38 and out of the opening 31 of the gas nozzle 30 into the operating system 100. A firearm equipped with the adjustable gas block 1 disclosed herein, through the use of the adjustment knob 20, can rotate the gas nozzle 30 into a position which blocks gas from entering the bore 38. This occurs when the adjustment knob 20 is rotated such that indexing notch 28 is in contact with the ball detent 23 thereby placing a non-ported portion of the gas nozzle 30 over the gas port 44 of the housing 10. If the adjustment knob 20 and thereby the gas nozzle 30 are rotated in such a manner as to allow the flow of gas into the operating system 100, one of the three gas ports 35-37 will be in direct communication with the gas port 44 located in the housing 10.

Once the adjustable gas block 1 is fully assembled onto a rifle as shown in FIG. 5, the adjustment knob 20 is received within the transverse groove 14 with the rear face of the knob adjacent the front end of the gas nozzle receiving channel cylindrical bore and the knob front face adjacent a rearwardly facing surface of the housing. When coupled to the gas nozzle 30, the adjustment knob 20 may be used to regulate the flow of gas between the barrel 101 and the operating system 100. In the preferred embodiment of the herein disclosed design, the adjustment knob 20 has four indexed positions 25, 26, 27 and 28. Also provided are the three gas ports 35, 36 and 37 which regulate the flow of gas into the bore 38, through the gas nozzle 30, and into the operating system 100. The adjustment knob 20 and the gas nozzle 30, when attached by the provided pin 21, form an assembly where the rotation of the adjustment knob 20 rotates the gas nozzle 30 within the housing 10. When the indexing notches 25-27 are in contact with the ball detent 23, a specific gas port 35-37 of the gas nozzle 30 is in communication with the gas port 44 of the housing 10. When indexing notch 28 is in contact with the ball detent 23, the gas nozzle 30 is rotated to a position where there is no gas port to communicate with the gas port 44 of the housing 10. Gas port three provides a flow of gas which is optimized for the proper functioning of the rifle based on its barrel length, caliber and operation under optimal conditions. Gas port three 37 is also referred to as the "standard" setting. Gas port one 35 has an opening which is larger than the opening of gas port three 37, thereby providing an increased quantity of gas to the operating system 100 of the host firearm. Gas port one 35 is used when the host weapon is dirty or the firearm's rate of fire needs be increased. Gas port one 35 is also referred to as the "adverse condition setting". The third gas port 36, generally referred to as gas port two, has an opening which is smaller in diameter than the opening of the "standard" gas port 37. Gas port two 36 is for use when a silencer is affixed to the muzzle of the barrel 101. This gas port 36 is also referred to as the "silencer setting".

In sum, an adjustable gas block is provided for an autoloading firearm which utilizes an indirect gas operating system. Four pre-set positions are afforded the user of this device. Gas settings which are optimized for suppressor use, harsh environments, dirty weapons or when firing under ideal circumstances are also provided for. A position which prevents the flow of gas into the operating system is provided for. This system does not vent excess gas from the gas block into the atmosphere around it. Instead excess gas is trapped within the barrel and vented from the muzzle where a flash hider or silencer might allow the gasses to expand and cool.

Another embodiment of the adjustable gas block could eliminate the increased gas flow setting or the setting which blocks the flow of gas.

Still another embodiment of the adjustable gas block could be adapted to work with a direct gas impingement system such as found on M16 style rifles. The nozzle assembled could be modified to receive the gas tube found on such system and thereby regulate the flow of gas from the barrel into the operating system.

While the above drawings and description contain much specificity, these should not be construed as limitations on the scope of the invention, but rather as an exemplification of one preferred embodiment thereof.

Accordingly, the scope of the invention should be determined not by the embodiments illustrated, but by the appended claims and their legal equivalents.

The invention claimed is:

1. An adjustable gas block for an indirect gas operated firearm, wherein the adjustable gas block comprises:

a nozzle comprising a forward end and back end, wherein said nozzle comprises a plurality of ports spaced about a forward portion of the nozzle, and wherein each of said plurality of ports can be selectively placed into communication with a barrel gas port of said firearm;

a gas block housing having a barrel receiving channel, and a cylindrical bore with a port, wherein said cylindrical bore receives said gas nozzle, and wherein said gas block housing comprises a groove formed therein to receive a rotatable knob, said groove running transverse to an axis of a barrel of said firearm and between a forward end of said cylindrical bore and a generally planar, rearwardly facing portion of said gas block housing; and a rotatable knob that receives and rotates the nozzle within said cylindrical bore, and said knob is removably retained by a spring loaded detent and ball, and said spring and detent work in conjunction with a series of notches present on said knob to prevent unintentional rotation of said knob, and said spring provides a force to said ball which interacts with said notches.

2. The adjustable gas block of claim 1, wherein said nozzle comprises two ports located about said forward portion of said nozzle for communication with said barrel gas port.

3. The adjustable gas block of claim 1, wherein said nozzle comprises three ports located about said forward portion of said nozzle for communication with said barrel gas port.

4. The adjustable gas block of claim 1, wherein said nozzle comprises four ports located about said forward portion of said nozzle for communication with said barrel gas port.

5. The adjustable gas block of claim 1, wherein said port of said cylindrical bore is aligned at an angle in relation to said cylindrical bore, and said cylindrical bore is configured to transmit gas from an opening to said port during operation.

6. The adjustable gas block of claim 1, wherein at least one of said ports of said nozzle is oversized in proportion to what should be a standard size for a rifle barrel used with a gas operating system of said indirect gas operated firearm.

7. The adjustable gas block of claim 1, wherein said rotatable knob comprises:

a plurality of selectable positions, all but one of said selectable positions correlating to position one of the plurality of ports of the nozzle into communication with said barrel gas port, and wherein one of said selectable positions rotating said nozzle into position such that no gas port is in communication with said barrel gas port.

8. The adjustable gas block of claim 1, wherein the nozzle has a rearward portion of said back end protruding from a rear portion of said gas block housing in alignment with said cylindrical bore.

9. The adjustable gas block of claim 8, wherein said protruding portion of said nozzle is rearward of said barrel gas port.

10. The adjustable gas block of claim 9, wherein said protruding portion of said nozzle has an internal bore to allow gas from one of said ports of said nozzle to reach a rearward opening in said nozzle, wherein said rearward opening in said nozzle is in communication with said gas operating system.

* * * * *